US008975985B2

(12) United States Patent
Meuriche

(10) Patent No.: US 8,975,985 B2
(45) Date of Patent: Mar. 10, 2015

(54) FREQUENCY-TUNABLE MICROWAVE BANDPASS FILTER

(75) Inventor: Bernard Meuriche, Colombes (FR)

(73) Assignee: Thales, Neuilly-sur-Seines (FR)

( * ) Notice: Subject to any disclaimer, the term of this patent is extended or adjusted under 35 U.S.C. 154(b) by 351 days.

(21) Appl. No.: 13/518,380

(22) PCT Filed: Dec. 17, 2010

(86) PCT No.: PCT/EP2010/070145
§ 371 (c)(1),
(2), (4) Date: Jul. 11, 2012

(87) PCT Pub. No.: WO2011/076698
PCT Pub. Date: Jun. 30, 2011

(65) Prior Publication Data

US 2013/0169384 A1 Jul. 4, 2013

(30) Foreign Application Priority Data

Dec. 22, 2009 (FR) ..... 09 06258

(51) Int. Cl.
*H01P 1/208* (2006.01)
*H01P 7/00* (2006.01)
*H01P 1/207* (2006.01)

(52) U.S. Cl.
CPC ..... *H01P 1/207* (2013.01); *H01P 1/208* (2013.01); *H01P 7/00* (2013.01)
USPC ..... 333/209; 333/235; 333/212

(58) Field of Classification Search
CPC ..... H01P 1/207; H01P 3/12; H01P 7/00; H01P 1/208
USPC ..... 333/209, 235, 212
See application file for complete search history.

(56) References Cited

U.S. PATENT DOCUMENTS 2,697,209 A 12/1954 Sichak et al.
3,577,104 A * 5/1971 Levy ..... 333/212
(Continued)

FOREIGN PATENT DOCUMENTS

GB 608254 A 9/1948
JP 2005102046 A 4/2005

OTHER PUBLICATIONS

Sichak W. et al.: "Tunable Waveguide Filters," Proceedings of the IRE, IEEE, Piscataway, NJ, US, vol. 39, No. 9, Sep. 1, 1951, pp. 1055-1059.
(Continued)

*Primary Examiner* — Robert Pascal
*Assistant Examiner* — Gerald Stevens
(74) *Attorney, Agent, or Firm* — Baker & Hostetler LLP

(57) ABSTRACT

A frequency-tunable microwave bandpass filter including a wave guide having a rectangular cross-section and including a stationary first conductive portion I and a movable second conductive portion II. The first portion includes first conductive partitions having one or more conductive obstacles related to complementary openings in the section of the guide that forms capacitive irises. The first partitions are transversely mounted, at the propagation of the wave in the guide, define cavities in the longitudinal direction of the guide, are rigidly connected to the first portion and the second conductive partitions that have one or more openings defining capacitive irises, and, in combination with the adjacent guide lengths, form immitance inverters. The first partitions form a series of resonating cavities coupled by the immitance inverters. A means ensures electrical contact between the conductive portions I and II.

9 Claims, 5 Drawing Sheets

(56) References Cited

U.S. PATENT DOCUMENTS

| | | | |
|---|---|---|---|
| 4,301,430 | A | 11/1981 | Stachejko |
| 4,761,625 | A | 8/1988 | Sharma |
| 5,808,528 | A | 9/1998 | Griffith et al. |

OTHER PUBLICATIONS

L. D. Smullin, "Design of tunable resonant cavities with constant bandwidth", Technical Report, Apr. 5, 1949, No. 106.

W. W. Mumford, "Maximally flat filters in waveguide", BSTJ, Oct. 1948, pp. 684-1173.

E. Roubine, "Circuits pour ondes ultracourtes", ESE, 1966.

Jia-Sheng Hong and M.J. Lancaster, "Microstrip filters for RF /Microwave Applications", John Wiley, 2001.

N Marcuvitz, "Waveguide Handbook", Radiation Laboratory series, 1951, No. 10, McGraw-Hill.

Anatol I Zverev, "Handbook of Filter Synthesis". Wiley-Interscience, p. 559, 1967.

* cited by examiner $$K = Z_0 \tan\left|\frac{\phi}{2}\right|$$

$$\phi = -\tan^{-1}\frac{2X}{Z_0}$$

$$\left|\frac{X}{Z_0}\right| = \frac{K/Z_0}{1-(K/Z_0)^2}$$

FREQUENCY-TUNABLE MICROWAVE BANDPASS FILTER

CROSS-REFERENCE TO RELATED APPLICATIONS

This application is a National Stage of International patent application PCT/EP2010/070145, filed on Dec. 17, 2010, which claims priority to foreign French patent application No. FR 09 06258, filed on Dec. 22, 2009, the disclosures of each of which are incorporated by reference in their entireties.

FIELD OF THE DISCLOSED SUBJECT MATTER

The invention relates notably to a frequency-tunable microwave bandpass filter produced by the waveguide technique.

BACKGROUND

Microwave frequency transmissions require the use of filters in transmission and in reception to select the frequency band in which the signal is transmitted. At microwave frequencies, it is possible to use guide-mode filters which make it possible to obtain low losses and a great selectivity.

In certain applications, it is advantageous to be able to tune the filter within a frequency band in order to be able to configure the hardware or the device at any moment and until operation according to the frequency of the signal to be transmitted.

There are a number of ways of producing guide-mode filters. Some use transverse partitions forming irises of inductive or capacitive type, others use longitudinal partitions (septums). The narrowest filters may have a relative bandwidth of a fraction of a percent of the center frequency.

The U.S. Pat. No. 5,808,528 [4] describes a bandpass filter which comprises a waveguide having a number of conductive walls and a moving wall defining the "large" dimension "a" of the waveguide. In this patent, use is made of the discontinuities created by a septum T with inductive obstacles in the vicinity of the axis of symmetry of the guide to define the cavities and the couplings of the filter (FIG. 1*a*).

The equivalent diagram of a guide cavity represented in FIG. 1*b* in accordance with the prior art [2] page 697 in which L is a line section of admittance Yo and jB is a line-end admittance.

The devices according to the prior art comprise cavities with inductive admittances at the end (produced by means of irises or of septums), for which the values of the equivalent inductive admittances (jB) at the ends of the cavities:

$$B/Yo \sim -(\lambda_g)/a * \cot^2(\pi d'/(2a))$$

(in which "a" and "d" are defined in FIG. 1*c*) depend directly on the dimension of the large side of the guide "a" and vary considerably when "a" varies when the small side "b" of the guide is displaced parallel to itself to adjust "a". FIG. 1*c* represents an example of an inductive iris according to the prior art.

SUMMARY

The object of the present invention relates to a frequency-tunable microwave bandpass filter comprising, in combination, at least the following elements:

a waveguide of rectangular section comprising a first fixed conductive portion I and a second moving conductive portion II, said first fixed portion I comprising three longitudinal conductive partitions forming three sides of the waveguide G, the section of the guide having a large side "a" defined by the position of the moving conductive portion II when it is inserted into the portion I and a small side "b", said first portion I comprising a number of first conductive partitions with one or more conductive obstacles associated with the complementary openings in the section of the waveguide forming irises of capacitive type, said first partitions being mounted transversely to the propagation of the wave in the guide and defining a number of cavities Ki in the longitudinal direction of the guide and attached to the first portion I, and a number of second conductive partitions with one or more openings i defining irises of capacitive type and which form, in association with the adjacent guide lengths, immittance inverters Ji, said first partitions forming a succession of resonant cavities Ki coupled by the immittance inverters Ji, said moving conductive portion II comprising a wall, parallel to the small side "b" of the guide, forming the fourth face of the waveguide G, said wall defining the value of dimension "a" of the large side of the guide, and thus the center frequency of the filter, the second portion II comprising a number of slots receiving the partitions of the portion I which form the irises of capacitive type, the cavities Ki thus being formed when the portion I and the portion II are fitted together, means for ensuring the electrical contact between the first fixed conductive portion I and the second moving conductive portion II.

The irises of capacitive type used to form the cavities Ki have, for example, an opening "d(x)" that is variable as a function of the abscissa x along the side "a" which makes it possible to keep the bandwidth of the filter constant when "a" varies. In a possible embodiment, the opening "d(x)" that is variable as a function of the abscissa x along the large side "a" may be a linear function to give this opening a trapezoidal form.

In a possible embodiment, the filter comprises, to ensure the electrical continuity along the moving small side "b" of the guide, a sprung sliding metallic contact made of copper alloy.

It is also possible to ensure the electrical continuity along the moving small side "b" of the guide by means of a sliding contact with conductive seals made of charged elastomer.

The filter may comprise, to ensure the electrical continuity along the moving small side "b" of the guide, a trap bringing a short circuit to the sliding points of contact "C" for a chosen guided wavelength.

The filter may comprise means for displacing the partitions of the capacitive irises of the cavities parallel to the small side "b" of the waveguide to vary the opening "d" identically at the ends of each cavity and thus simultaneously change the value of the overvoltage coefficient Q for all the cavities Ki.

The filter may also comprise means making it possible to vary the opening "d" of the capacitive irises of the cavities when the narrow adjustable side "b" of the guide is displaced with the moving side II by using one of the two methods described below:

- by a separate control, motor-driven or not, and common to all the cavities,
- by thrusting the irises of the cavities upward parallel to the small side "b" of the waveguide to increase the value of "d" when the value "a" of the large side is reduced by a thrust device compensated in the reverse direction.

The moving partition associated with the moving conductive side II of the guide is displaced mechanically parallel to itself by one or more rotary or linear or piezoelectric motors.

BRIEF DESCRIPTION OF THE DRAWINGS

Other features and advantages of the device according to the invention will become more apparent on reading the following description of an exemplary embodiment given as a nonlimiting illustration with appended figures which represent.

DETAILED DESCRIPTION

The description relates to a waveguide filter having a stability in the bandwidth when it is tuned in frequency. According to the proposed last embodiment, the passband width is practically insensitive to the change of frequency tuning.

Figure 1A:
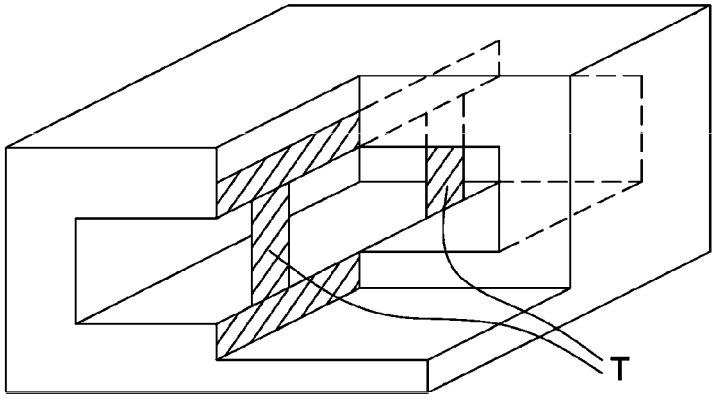
FIG.1a (Prior Art)
FIG. 1*a*, an exemplary cavity using a septum with inductive obstacles according to the prior art, FIG. 1*b* the equivalent diagram of a waveguide cavity according to the prior art, FIG. 1*c* an exemplary inductive iris used according to the prior art to limit such a cavity, FIG. 2, a bandpass waveguide filter with rectangular section consisting of two conductive portions I and II, FIG. 3, the way in which the two portions I and II of FIG. 2 are fitted together to form the waveguide filter, FIG. 4, a cross-sectional view of a transverse section of the waveguide, FIG. 5, a cross-sectional view of a longitudinal section of the guide filter consisting of a succession of resonant cavities and immittance inverters, FIG. 6*a*, a number of exemplary embodiments of capacitive irises, FIG. 6*b*, an exemplary iris having an opening in trapezoidal form making it possible to keep the bandwidth of the filter practically constant when the center frequency of the filter varies with "a", FIGS. 7*a*, 7*b* and 7*c*, a number of embodiments for producing a contact ensuring the electrical continuity between the two portions I and II, and FIG. 8, a schematic diagram used for the immittance inverter calculation.
Figure 1B:
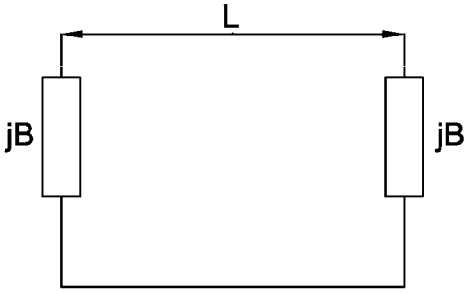
FIG.1b (Prior Art)
Figure 1C:
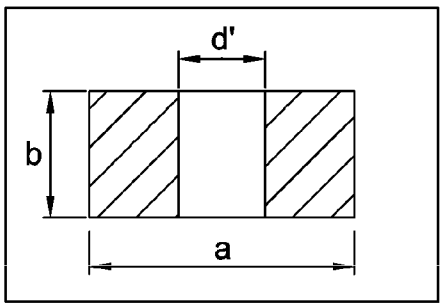
FIG.1c (Prior Art)
Figure 2:
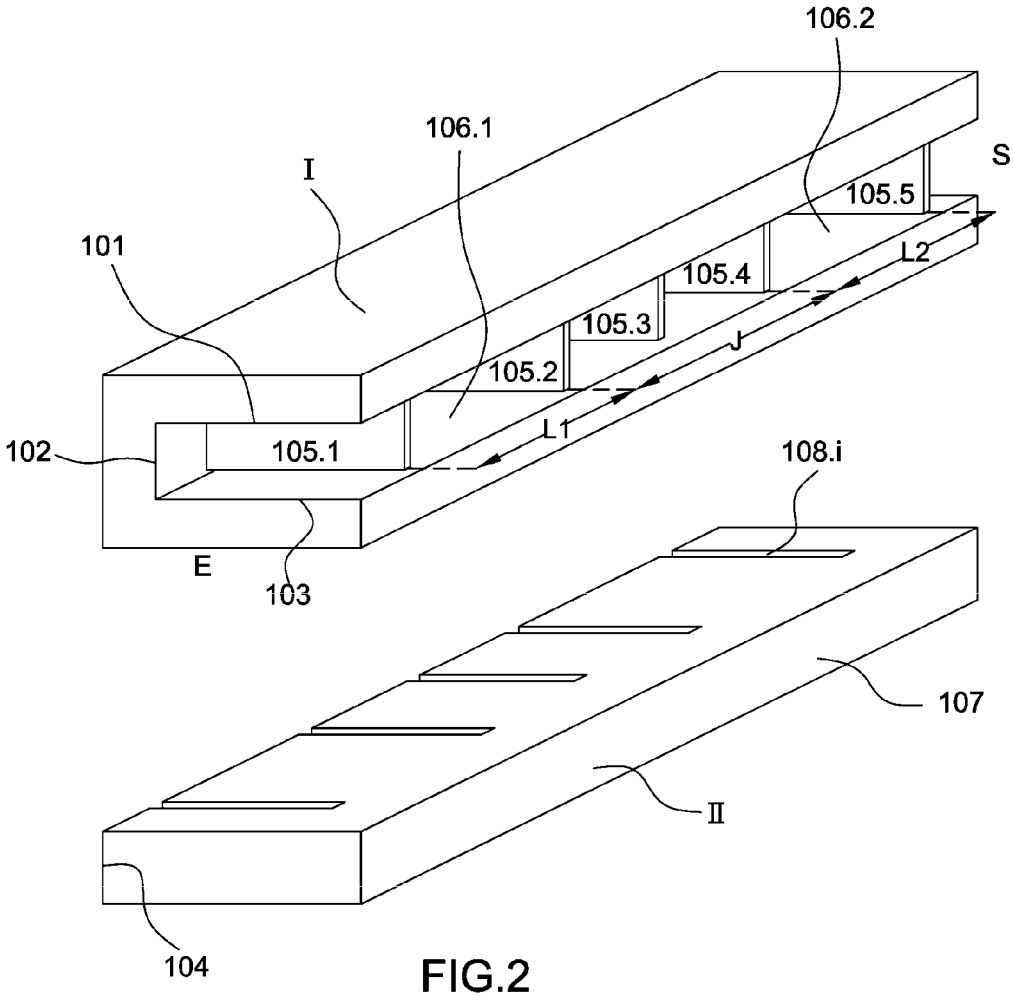

FIG. 2 describes a portion of a bandpass waveguide filter with rectangular section which comprises, for example, the following elements:

- three longitudinal conductive partitions 101, 102, 103 forming three sides of a fixed portion I of the waveguide G,
- conductive partitions attached to the portion I: $\mathbf{105}_1$, $\mathbf{105}_2$ and $\mathbf{105}_4$, $\mathbf{105}_5$ with one or more conductive obstacles associated with complementary openings Oi in the section of the guide forming irises of capacitive type (ref. [1] and [7]), the partitions being mounted transversely to the propagation of the wave in the guide from E to S. The partitions $\mathbf{105}_1$ and $\mathbf{105}_2$ define the cavity ($K_1$) $\mathbf{106}_1$ of length L1 and the partitions $\mathbf{105}_4$,$\mathbf{105}_5$ define the cavity ($K_2$) $\mathbf{106}_2$ of length L2. The partition $\mathbf{105}_3$ with an opening defining an iris of capacitive type which comprises an opening "i" (FIG. 5), and forms, with the two adjacent guide lengths L3 and L4, an immittance inverter J between the two cavities $\mathbf{106}_1$ and $\mathbf{106}_2$,
- a lateral wall 104 forming the face of II which constitutes the fourth side of the guide and which is located facing the partition 102. The portion II is sunk or inserted into the portion I on the small side "b" of the guide, making it possible to define the value of the dimension of the large side of the guide "a", allowing passage by means of slots 108*i* having dimensions chosen to receive the partitions of the portion I which form the irises of capacitive type, and closing the guide on the fourth side 104 of the guide of internal dimension "b". The reference 107 corresponds to the external moving partition of the waveguide G when the first fixed portion I and the second moving portion II are fitted into one another.

The values of the parameters "a", "b" and "d" are chosen according to the frequency of the filter and the dimensions of the guide which are functions of this frequency. In practice, for example, "a"~"b"12 and "d" should make it possible to produce the opening.

Figure 3:
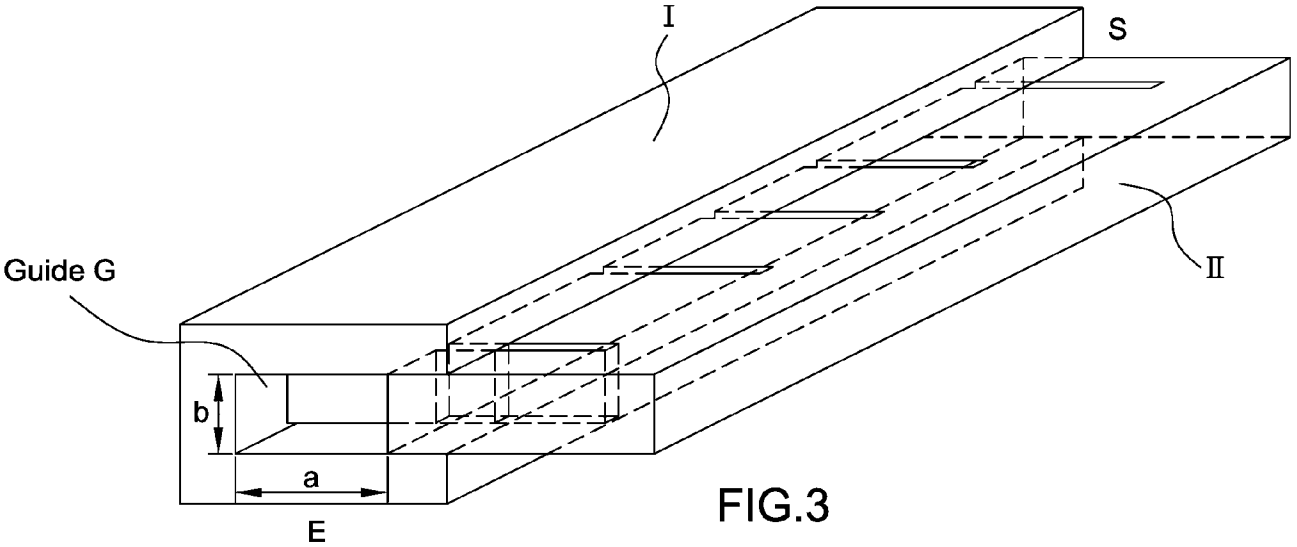

The two conductive portions I and II are fitted as described in FIG. 3. The signal is propagated between the input E and output S portions of the waveguide G by passing through the openings Oi of height "d" of the capacitive irises through the cavities Ki which are thus formed by the transverse partitions and the walls of the guide and through the openings "i" of the walls, the function of which is notably to produce an immittance inversion function.

Figure 4:
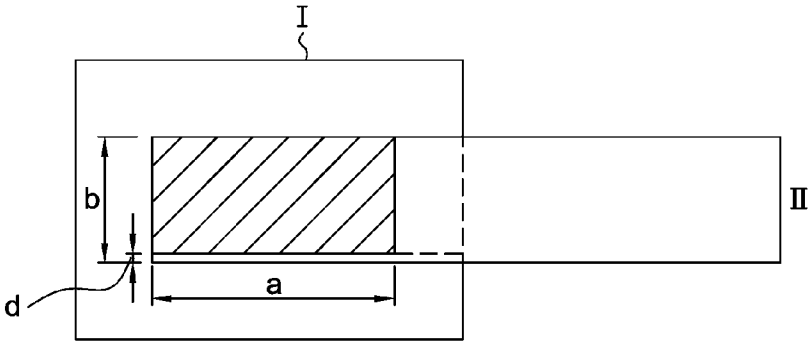

The form of the capacitive openings and the dimension "d" or "i" of their opening under each transverse partition (iris) is determined so as to obtain the frequency response and the selectivity which are desired for the filter (see FIG. 4).

The side of the moving portion II of the waveguide, which closes all the cavities, is adjusted manually or mechanically by means of a single adjustment to displace the filter in frequency in the desired band. The filter is therefore tuned throughout the band to be covered by means of this single adjustment of the dimension of the side "a". The moving conductive partition II of the guide can be displaced mechanically parallel to itself by one or more rotary or linear or piezoelectric or similar motors. The mechanical displacement can be controlled by software. These displacement means are known to those skilled in the art and will not therefore be represented in the interests of simplification.

Operation of the Tunable Waveguide Filter According to the Invention

In a rectangular guide of large side "a" and of small side "b", the guided wavelength "$\lambda_g$" of a signal at the frequency f is equal to:

$$\lambda_g=1/(f^2/c^2-1/(2a)^2)\hat{}\,½$$

in which "a" is the dimension of the large side of the guide of rectangular section.

By varying "a", it is possible to have the same guided wavelength $\lambda_g$ in the filter for different frequencies $f_1$ and $f_2$ with sides respectively "$a_1$" and "$a_2$":

$$\lambda_g=1/(f_1^2/c^2-1/(2a_1)^2)\hat{}\,½=1/(f_2^2/c^2-1/(2a_2)^2)\hat{}\,½$$

In cavity filters, for a rectangular guide, a cavity has a length L close to "$\lambda_g$"/2, and its overvoltage coefficient Q under load is a function of the openings of the irises at the end (couplings jB) (ref. [2]).

Since the overvoltage coefficients (Q) of each resonator are determined, the architecture or design of the filter is obtained by an association of resonators in series and parallel.

If two different frequencies have the same guided wavelength, "$\lambda_g$", in the guide, since the cavities keep the same length L, and if the couplings between cavities remain equal, the response of the filter is similar at the two frequencies.

According to the approximate equations given in ref. [1], it can be seen that the couplings jB of capacitive type depend only on the height of the opening "d" and on the dimension of the small side "b", which do not vary when "a" varies (see FIG. 4). For example, for an iris with a single rectangular opening of height "d" in a guide of small side "b", the following applies:

$$B/Yo\sim 8b/(\lambda_g)*\mathrm{LN}(csc(\pi d/2b))$$

With B being the admittance of the iris, Yo the reference admittance and LN being the Neperien logarithm.

This property of independence of the value of B relative to "a" remains valid for all the types of capacitive irises ([7] pages 218-221 or 248-255 or 404-406 depending on their form and their thickness).

Therefore, a rectangular waveguide filter with capacitive coupling cavities for which the large side "a" is varied by means of a moving partition on the small side "b" and for cavities with fixed "$\lambda_g$", will:

have its center frequency f which varies, keep its couplings and Q almost constant, and therefore the bandwidth of the filter will remain almost constant.

The dimensions and the form of the capacitive irises of the cavities that have feasible dimensions (opening "d") are determined, for example, as described below. The "design" is obtained by setting the overvoltage values Q of the cavities Ki which make it possible to have reasonable iris openings and by coupling the cavities by means of immittance inverters. These immittance inverters of value J also have to use irises of capacitive type for their value to be independent of "a" when the small side of the guide "b" is displaced.

Figure 8:
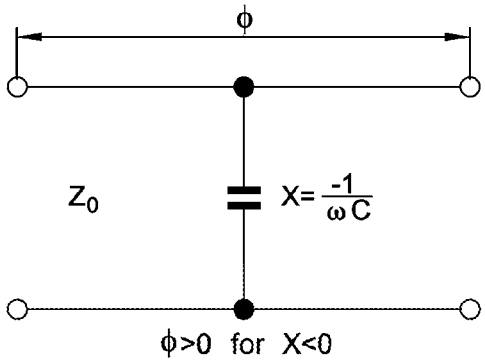
FIG.8 (Prior Art)

An exemplary immittance inverter suited to this application is known to those skilled in the art and conforms to the diagram of FIG. 8 in accordance with the example on page 63 of reference [5].

The design or architecture of the tunable filter according to the invention is obtained, for example, by using methods known to those skilled in the art, as is explained in [5] page 59 or in [6] page 559. For example, the structure of a 4th order filter is obtained by placing the four cavities (Ki) between the immittance inverters Ji:

J1 K1 J2 K2 J3 K3 J4 K4 J5

Figure 5:
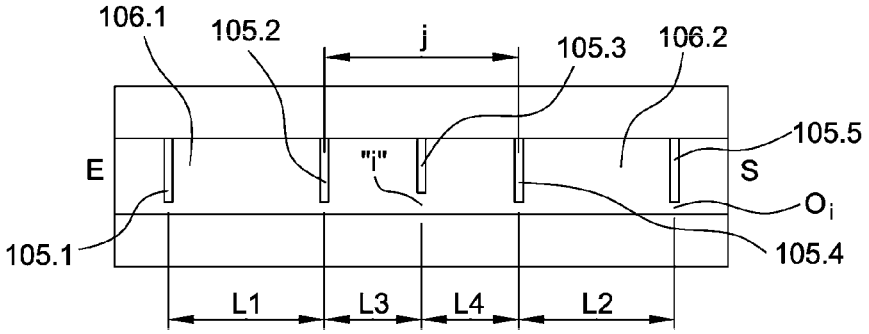

(see a portion of this filter in FIG. 5: $L_1$ and $L_2$ represent the lengths of the cavity portion K1 and K2, and J represents the immittance inversion portion)

The capacitive irises used may be thin or thick. The equations used to calculate their respective equivalent diagrams are known from the prior art, for example, [7] (pages 218-221 or 248-255 or 404-406 depending on their form and their thickness).

The capacitive irises may comprise one or more transverse conductive obstacles associated with one or more corresponding openings, which are complementary in the section of the guide.

Figure 6A:
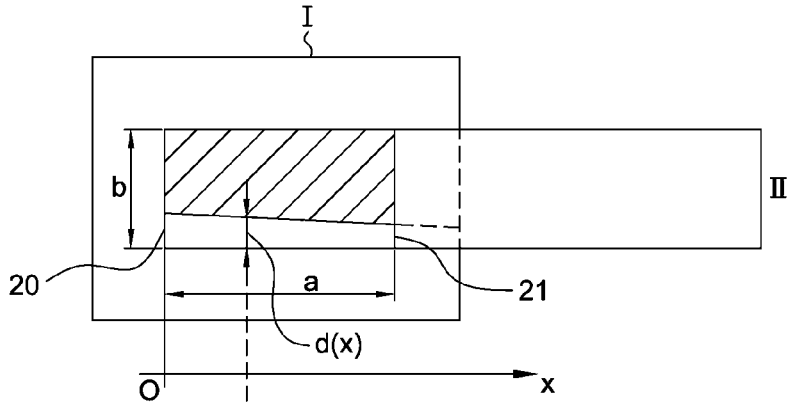

The nonlimiting FIG. 6*a* represents a number of possible embodiments of this type of iris. For example, the conductive obstacle 51 associated with the two complementary openings O1 in the section of the waveguide forms such an iris. Similarly, the conductive obstacles 52 and 53 associated with the complementary median opening O2 in the section of the guide constitute an iris of this type. The two conductive obstacles 55 and 56 associated with the three complementary openings O3 also form a capacitive iris.

The transverse conductive obstacle 54 associated with its complementary opening O4 in the section of the guide is a capacitive iris similar to the one represented in the guide of FIG. 4.

A more precise analysis of the overvoltage coefficient of a cavity shows that it is a function of:

the susceptance jB of the iris ($jB_o$ has the same value at the center frequency $f_o$ of the cavity regardless of its value in the band to be covered when "a" varies), the guided wavelength "$\lambda_{go}$", constant at the center frequency $f_o$ of the cavity when "a" varies, the length of the cavity L, constant, the wavelength in air at the transmitted frequency $f_o$, The following applies as a first approximation:

$$Q=kf_o^2$$

with k ($B_o$, $\lambda_{go}$, L) constant when the center frequency of the cavity varies.

Since BW', the bandwidth of the resonator, is equal to $f_o/Q$, the following is obtained as a first approximation:

$$BW'=k'/f_o$$

It can be seen that, for a frequency displacement of +/−5% (for example +/−300 MHz at 6 GHz), the bandwidth of the resonator will vary by −/+5% because fo varies (for example −/+1 MHz for BW=20 MHz when $f_o$ varies by +/−5%).

According to another embodiment, and in order to compensate the variation of the bandwidth BW of the filter as a function of the center frequency $f_o$, one solution is to vary $B_o$ by changing the opening "d" of the capacitive irises of the cavities.

A first method is to make this iris mobile parallel to the small side of the guide while maintaining the electrical contact with the fixed and moving portions forming the cavity. One possible adjustment consists in displacing the partition of the iris parallel to the small side "b" of the waveguide in order to vary the opening "d" identically at the ends of each cavity and thus simultaneously change the value of Q for all the cavities. The change of "d" in practice is small, of the order of a few tenths of millimeters. However, it is essential not to change the values of the openings "i" of the capacitive irises used as immittance inverter J to ensure that these inverters retain the same value J.

The frequency response of the duly adjusted filter, and regardless of the number of poles of the filter, is then exactly the same throughout the band covered and requires only two adjustments "a" and "d" in all for the filter.

The variation of the opening "d" of the capacitive iris can be obtained when the narrow adjustable side "b" of the guide (partition 107) is displaced with the moving side II, for example, by using one of the two methods described below:

by a separate control, motor-driven or not, and common to all the cavities, by thrusting the irises of the cavities upward to increase the value of "d" when the value "a" of the large side is reduced by a thrust device compensated in the reverse direction, for example, by a spring.

Figure 6B:
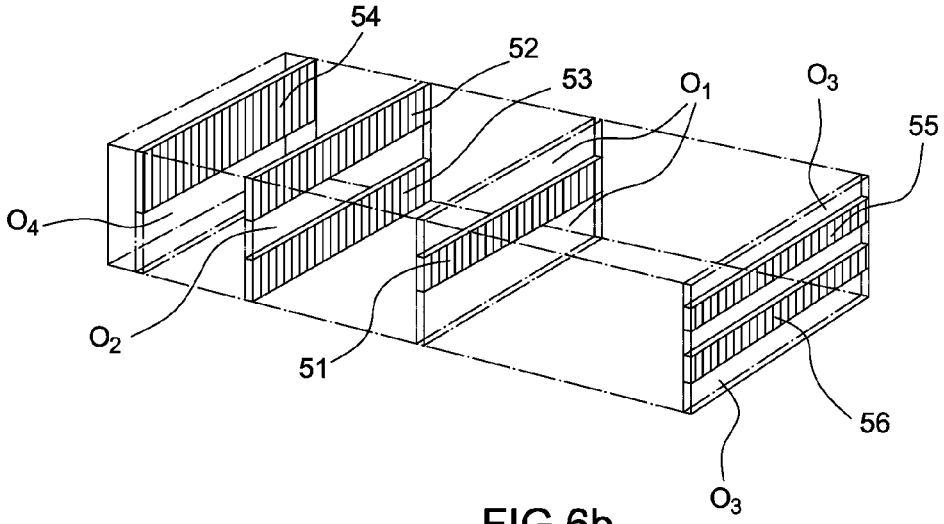

According to another exemplary embodiment, represented in FIG. 6*b*, it is possible to increase the apparent value "d" of the capacitive irises used for the resonant cavities when "a" decreases.

To obtain this result, the opening "d" has a value that is slightly variable along the dimension x of the large side "a". When the small side of the guide associated with the moving conductive portion II is displaced by increasing the value of "a", the apparent opening of the iris "d(x)" decreases which makes it possible to slightly vary the overvoltage coefficient Q to compensate the variation of the bandwidth of the filter BW when $f_o$ varies.

An approximate form of the opening is, for example, obtained from the calculation of "d(x)" at the two extreme frequency points of the band to be covered by $f_o$. This form of the iris represented in FIG. 6*b* is then a trapezoid rectangle whose large base 20 is located on the wall "b" of the fixed portion I of the guide, the smaller side 21 being on the side of the opening receiving the moving portion II.

By increasing the number of calculation points in the frequency band covered by the filter when its center frequency $f_0$ is varied by keeping its bandwidth BW constant or substantially constant, a more precise form is obtained for the opening "d(x)" as a function of the abscissa x along the large side "a".

Stray Responses

The stray responses of the filter, close to the cut-off frequency of the guide which is a function of "a", are eliminated by placing, for example, in series with the tunable filter, a suitable length of guide under the cut-off at these frequencies.

Sliding Contacts

The tunable filter according to the invention can use at least three types of sliding contacts C to ensure the electrical continuity along the moving small side of the guide.

Figure 7A:
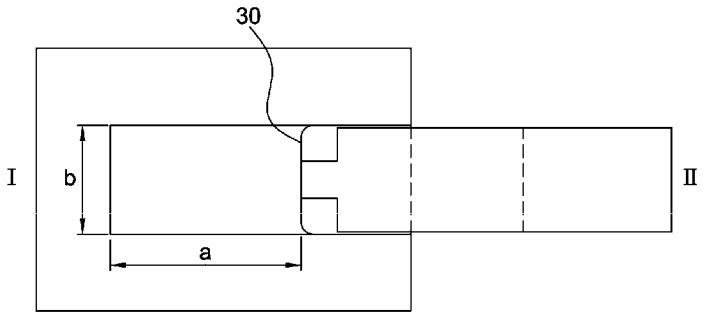

The first possibility is to employ a sprung metallic part 30 made of copper alloy fastened to the moving partition and supplying a spring action to maintain the relative position of the moving partition and of the conductive walls (see FIG. 7*a*).

Figure 7B:
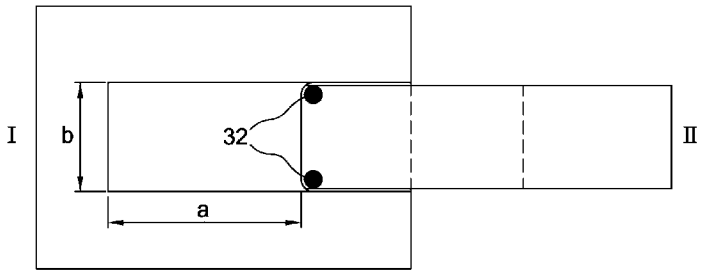

The second uses a sliding contact with (see FIG. 7*b*). The moving partition has one or more grooves along the moving partition in which conductive seals 32 made of charged elastomer make it possible to maintain the ohmic contact.

Figure 7C:
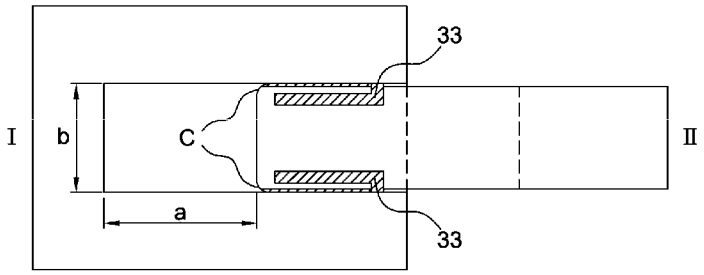

The third solution is to ensure the contact according to the traps technique used to ensure a good electrical continuity at the junction between guides (see ref. [3]). It consists in providing, by means of a trap (33), a short circuit at the sliding points of contact ("C") for a chosen guided wavelength (see FIG. 7*c*). The trap is formed by the complete cutout schematically represented by the cross-hatching. This solution seems to be advantageous given the fact that "$\lambda_{go}$" is constant in the guide when "a" varies, for any center frequency $f_o$ of the filter.

Therefore, a rectangular waveguide filter with capacitive coupling cavities for which the large side "a" is varied by means of a moving partition on the small side "b" (and for cavities with fixed "$\lambda_g$"), will:

have its center frequency f which varies keep its couplings and Q almost constant, and therefore the bandwidth of the filter will remain almost constant.

This is not the case for the filters that use inductive irises or septums for which the equivalent admittances at the ends of cavities jB depend directly on the large width of the guide "a" and vary considerably when "a" varies.

REFERENCES

[1] "Design of tunable resonant cavities with constant bandwidth" L. D. Smullin Technical Report n° 106 RLE/MIT 1949.

[2] "Maximally flat filters in waveguide", W. W. Mumford, BSTJ October 1948, p 684-713.

[3] "Circuits pour ondes ultracourtes" E. Roubine ESE 1966.

[4] U.S. Pat. No. 5,808,528.

[5] "Microstrip filters for RF/Microwave Applications" Jia-Sheng Hong and M. J. Lancaster, John Wiley 2001.

[6] "Handbook of Filter Synthesis" Anatol I Zverev, Wiley-Interscience.

[7] "Waveguide Handbook" N Marcuvitz, Radiation Laboratory series n° 10, McGraw-Hill, 1951.

The invention claimed is:

1. A frequency-tunable microwave bandpass filter, comprising:

a waveguide of rectangular section comprising a first fixed conductive portion and a second moving conductive portion; and a connector ensuring electrical contact between the first fixed conductive portion and the second moving conductive portion, wherein:

said first fixed conductive portion comprises three longitudinal conductive partitions forming three sides of the waveguide, the rectangular section of the waveguide comprising a large side defined by a position of the second moving conductive portion when the second moving conductive portion is inserted into the first fixed conductive portion, and the rectangular section of the waveguide comprising a small side;

said first fixed conductive portion further comprises first conductive partitions comprising one or more conductive obstacles associated with complementary openings in the rectangular section of the waveguide to form irises of capacitive type, said first conductive partitions being mounted transversely to a direction of propagation of a wave in the waveguide and defining a number of resonant cavities Ki in a longitudinal direction of the waveguide and attached to the first fixed conductive portion, said first fixed conductive portion further comprises second conductive partitions comprising one or more openings defining irises of capacitive type to form, in association with adjacent guide lengths and immittance inverters, said first conductive partitions forming a succession of the resonant cavities Ki coupled together by the immittance inverters;

said second moving conductive portion comprises a wall parallel to the small side of the waveguide, the wall forming a fourth face of the waveguide, said wall defining a dimension of the large side of the waveguide and a center frequency of the tunable filter, and said second moving conductive portion further comprises slots receiving the first conductive partitions of the first fixed conductive portion which form the irises of capacitive type, the resonant cavities Ki being formed when the first fixed conductive portion and the second moving conductive portion are fitted together.

2. The tunable filter as claimed in claim 1, wherein the irises of capacitive type used to form the resonant cavities Ki have an opening of variable dimension along the small side that is variable as a function of an abscissa along the large side such that a bandwidth of the tunable filter is constant when the large side varies.

3. The tunable filter as claimed in claim 2, further comprising means for varying the opening of variable dimension of the capacitive irises of the resonant cavities when the small side of the waveguide is displaced with the second moving conductive portion by:

a separate control that is common to all the resonant cavities, or thrusting the capacitive irises of the resonant cavities upward parallel to the small side of the waveguide to increase the opening of variable dimension when the large side is reduced by a thrust device compensated in a reverse direction.

4. The tunable filter as claimed in claim 2, wherein the opening of variable dimension is variable as a linear function such that the opening has a trapezoidal form.

5. The tunable filter as claimed in claim 1, further comprising a metallic part fastened to the second moving conductive portion and configured to supply a spring action to maintain a relative position between the second moving conductive portion and the wall.

6. The tunable filter as claimed in claim 1, wherein said second moving conductive portion further comprises one or more grooves along the second moving conductive portion in which conductive seals made of charged elastomer maintain the electrical contact.

7. The tunable filter as claimed in claim 1, further comprising a trap bringing a short circuit to points of contact for a chosen guided wavelength, the trap ensuring the electrical contact between the first fixed conductive portion and the second moving conductive portion along the small side of the waveguide.

8. The tunable filter as claimed in claim 1, further comprising means for displacing the first conductive partitions of the capacitive irises of the resonant cavities parallel to the small side of the waveguide to vary openings identically at ends of each cavity to simultaneously change an overvoltage coefficient for all of the resonant cavities Ki.

9. The tunable filter as claimed in claim 1, wherein a moving partition associated with the second moving conductive portion of the waveguide is displaced mechanically parallel to the moving partition by one or more rotary, linear or piezoelectric motors.

* * * * *